US010717015B2

(12) United States Patent
Hreniuk-Mitchell

(10) Patent No.: US 10,717,015 B2
(45) Date of Patent: Jul. 21, 2020

(54) HIGH ANGLE TETHERED SLIDE WITH FREEFALL DROP AND VARIABLE RADIUS SWING

(71) Applicant: Buttercup Enterprises, Inc., Road Town, Tortula (VG)

(72) Inventor: Darren W. Hreniuk-Mitchell, San Jose (CR)

(73) Assignee: Buttercup Business, Inc., Tortula (VG)

( * ) Notice: Subject to any disclaimer, the term of this patent is extended or adjusted under 35 U.S.C. 154(b) by 0 days.

(21) Appl. No.: 16/538,094

(22) Filed: Aug. 12, 2019

(65) Prior Publication Data

US 2020/0023283 A1 Jan. 23, 2020

Related U.S. Application Data

(63) Continuation-in-part of application No. 15/038,171, filed on May 20, 2016, now Pat. No. 10,376,798.

(51) Int. Cl.

| | |
|---|---|
| ***A63G 31/02*** | (2006.01) |
| ***A63G 21/16*** | (2006.01) |
| ***A63G 31/00*** | (2006.01) |
| ***A63B 69/00*** | (2006.01) |
| ***A63G 21/22*** | (2006.01) |
| ***A63G 21/02*** | (2006.01) |
| ***A63B 9/00*** | (2006.01) |

(52) U.S. Cl.

CPC ..... *A63G 31/02* (2013.01); *A63B 69/0048* (2013.01); *A63B 2009/004* (2013.01); *A63G 21/02* (2013.01); *A63G 21/16* (2013.01); *A63G 21/22* (2013.01); *A63G 2031/002* (2013.01)

(58) Field of Classification Search

CPC . A63G 31/00; A63G 9/00; A63G 9/12; A63G 21/02; A63B 69/0048; A63B 2013/002; B61B 12/02

See application file for complete search history.

(56) References Cited

U.S. PATENT DOCUMENTS

| | | | | |
|---|---|---|---|---|
| 1,511,139 A * | 10/1924 | Leo-Roziger | ..... | A63G 21/10 472/116 |
| D386,237 S * | 11/1997 | Artwick | ..... | D21/826 |
| 10,016,634 B2 * | 7/2018 | Weston | ..... | A63G 21/20 |
| 2003/0183449 A1 * | 10/2003 | Martin | ..... | E06C 7/186 182/8 |

* cited by examiner

*Primary Examiner* — Michael D Dennis

(74) *Attorney, Agent, or Firm* — Mueller Law, LLC; Jerry K. Mueller, Jr.

(57) ABSTRACT

An amusement ride requires the participant to ascend to a platform for the beginning of the amusement ride via a single or a double helix ladder. The participants are tethered for safety. Operators attend the tether lines. The tethers also can run through belays for safety.

2 Claims, 7 Drawing Sheets

FIG. 7
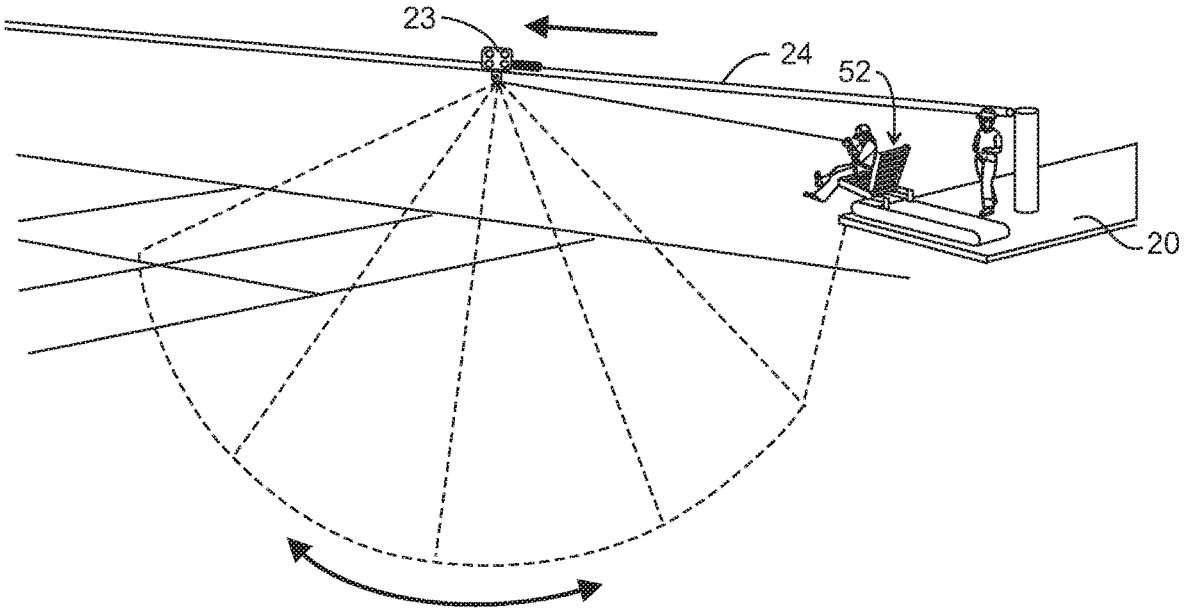
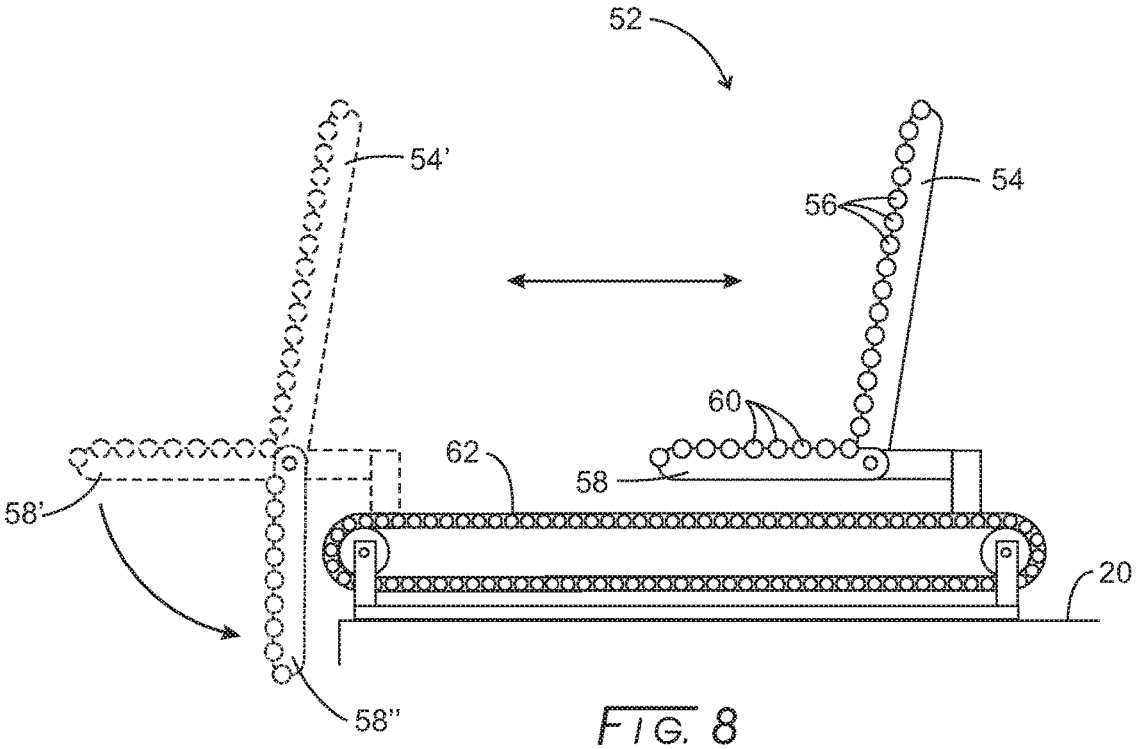
FIG. 8

FIG. 9
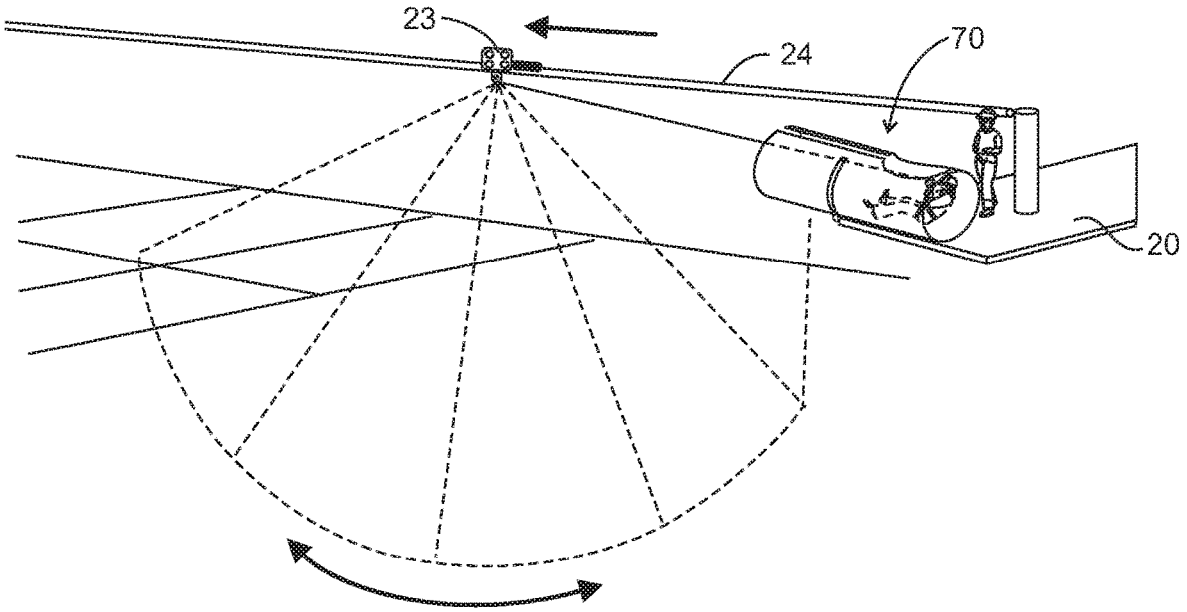
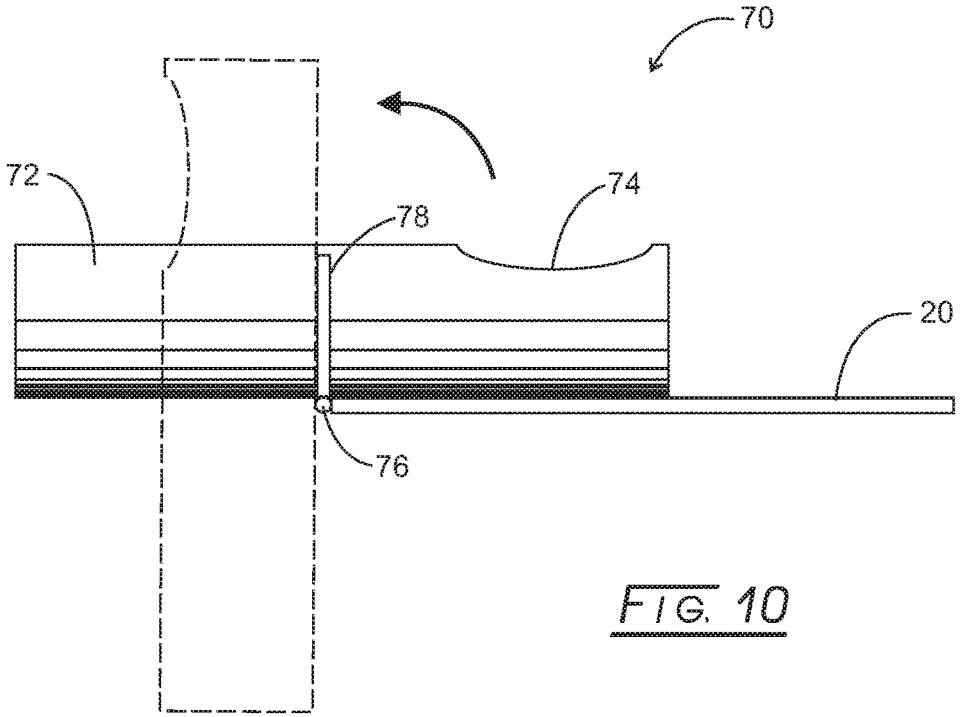
FIG. 10

HIGH ANGLE TETHERED SLIDE WITH FREEFALL DROP AND VARIABLE RADIUS SWING

CROSS-REFERENCE TO RELATED APPLICATIONS

This application is a continuation-in-part of U.S. Ser. No. 15/038,171 filed May 20, 2016, now U.S. Pat. No. 10,376,798, which claimed priority of application CA 2014/051196 of Dec. 11, 2014, the disclosures of which is expressly incorporated herein by reference.

STATEMENT REGARDING FEDERALLY SPONSORED RESEARCH AND DEVELOPMENT

Not applicable.

THE NAMES OF THE PARTIES TO A JOINT RESEARCH AGREEMENT

Not applicable.

REFERENCE TO A "SEQUENCE LISTING," A TABLE, OR A COMPUTER PROGRAM

Not applicable.

STATEMENT REGARDING PRIOR DISCLOSURES BY THE INVENTOR OR A JOINT INVENTOR

Not applicable.

BACKGROUND OF THE INVENTION

This disclosure generally relates to the amusement field and more specifically to amusement or recreational rides. Certain settings are space limited and do not permit large entertainment rides. Moreover, some settings have limited access to power. For such settings, compact amusement rides requiring little to no power are required. Such settings can be in remote locations away from the electrical grid, such as aboard a luxury cruise liner.

Modern cruise liners offer a variety of entertainment, which now includes amusement-type rides, such as water slides. There is, thus, a need to provide an amusement ride that can successfully operate in a limited area (small footprint) using little to no power, while providing a high thrill value to the rider. It is to such need that the disclosed apparatus is addressed.

An improved canopy tour ride is disclosed in U.S. Pat. No. 8,505,462. The dual safety line disclosed therein can be used in the presently disclosed ride.

BRIEF SUMMARY OF THE INVENTION

This disclosed apparatus was developed initially to provide an amusement ride in a limited area using nothing more than human power, while providing a multitude of sensory experiences in rapid succession in a high angle environment safely and with a minimum number of operators.

An amusement ride requires the participant to ascend to a platform for the beginning of the amusement ride via a single or a double helix ladder. The participants are tethered for safety. Operators attend the tether lines. The tethers also can run through belays for safety.

An amusement ride is formed from a height/climbing component, which could be in the form of a tower with various assisted and unassisted ascension methods, such as, for example, a climbing wall, a climbing net, and a spiral staircase. Once at height, there are 2 systems for getting down from the activity deck. The first is a static or dynamic synthetic rope or tether attached to a participant, which rope passes through a pulley or other non-binding pivot or redirection device at a fixed point in front of and above the deck where the participant is located. The attachment point for this system can be any fixed point in front of and at/above head height of a slide, for example. The attachment point even can be a pole, as shown in the drawings, then back to the system operator who has control of the cable/rope, as it passes through a brake/belay device. The operator adds tension to the cable/rope pulling the participant off the deck. The participant then falls and swings freely in a pendular motion from the anchor point. The operator then lowers the participant to a lower ship's deck, the ground, into a pool, a net, a barrel of balls, shaving cream, or any other landing option.

The disclosed system can be augmented by adding a baffle device which, when hung in front of the activity deck, adds excitement by shrouding the passenger in darkness as they fall through it, while at the same time, creating noise and disorientation as they travel within the baffle device, adding to the experience, but also adding a secondary benefit of slowing down the descent and directing the participant into a smaller and more controlled arc, as well as adding a sudden free-fall style drop at the end of the baffle experience.

A second system adds a traverse component and end swing to the primary drop component and includes a single traverse line or a self-equalizing dual line safety system, as previously described in U.S. Pat. No. 8,505,264. The participant is attached to a carriage with a determined length of rope/cable tether. From an end of an upper platform, the operator pushes the carriage system, which causes the passenger to be pulled off the deck and down into a baffle system. The baffle system causes the same effect described above, shrouding the participant in darkness while slowing the participant down and changing their vector so that, upon exiting from the baffle system, the participant is caused to make a short and controlled drop with required forward momentum in order to complete the traverse at the required velocity.

The second system can be further improved by reconfiguring the dual line safety system to be a continuous loop that incorporates counterweights located inside anchor towers at either or both extremities of the traverse, which counterweights move the actual cable within the dual line system in such a way as to cause stop blocks to be positioned at either a loading or operating position.

The participant's weight also becomes part of the actuation of the system, as when the participant hits the lower extremity of the system in the locked position, the participant swings in a pendular motion until the operator decides to unlock the system at which time the participant's weight, along with that of the lower counterbalance, moves the blocks into the loading position as the participant is lowered to a disembarkation deck.

At this time, coincident with the motion of the lower block moving to the disembarkation position, the upper block moves in to the loading position. Once the participant is loaded, the system then is activated to move into the launching position, as the upper block moves down towards the end of the system and while pulling the participant's tether taut; The lower stop block moves into the stopping limit position, causing the participant to stop short of the end of the system so they may swing freely to dissipate kinetic energy and avoid collision with the end anchor pole. When the lower operator decides that the participant is ready to be disembarked, the lower operator unlocks the system, allowing the participant to move to the unloading deck and resetting the system for the next participant.

Both disclosed systems can be improved further with the addition of (1) a roller seat on the activity deck, which is a "chair" made of rollers that has two positions. Position 1 is in the shape of a chair and when activated, the seat flattens out into a slide launching the passenger; or (2) an articulated launch tube device where the passenger is drawn down a tube by the tether to a point at the edge of the platform where there is a pivot point in the tube and, as the passenger passes over the pivot point, the passenger's weight causes the tube to change orientation from horizontal to vertical, resulting in dropping/launching the passenger.

BRIEF DESCRIPTION OF THE SEVERAL VIEWS OF THE DRAWINGS

For a fuller understanding of the nature and advantages of the present apparatus and method, reference should be had to the following detailed description taken in connection with the accompanying drawings, in which:

FIG. 7 is an isometric view of the first amusement ride embodiment using a drop seat to launch the participant;

FIG. 8 is a side view of the drop chair shown in FIG. 7;

FIG. 9 is an isometric view of an alternative view of a transverse tether canal for launching a participant;

FIG. 10 is a side view of the transverse tether canal of FIG. 9; and

The drawings will be described in greater detail below.

DETAILED DESCRIPTION OF THE INVENTION

Figure 1:
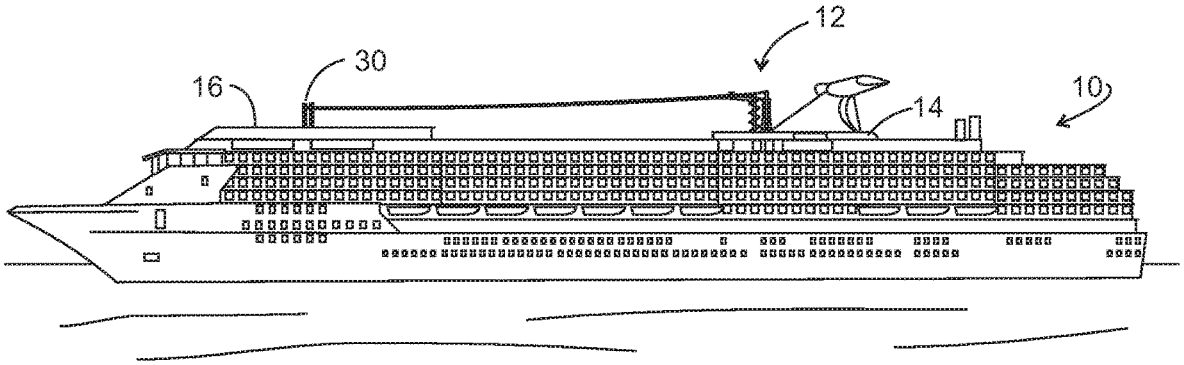
FIG. 1 is a side view of the amusement ride embodiment aboard a cruise liner.

Referring initially to FIG. 1, a cruise ship, 10, is seen on the sea. Since space is limited aboard cruise ship 10, cruise ship operators are constantly seeking additional activities for its passengers, especially, if such activities do not take additional deck space. A traverse ride, 12, is seen extending above ship 10 giving the passengers a thrill with its vertical height and amazing views from such height, while taking up no deck space, causing any congestion, or detracting from deck activities already aboard ship 10. It should be noted, however, that the disclosed system and its variants could be installed at a beach location, rooftop, inside a mall, or at just about any desired location where an operator can provide thrill and excitement to customers. The limited space aboard a ship created certain challenges in the design of the disclosed system. Once the system was designed for use aboard a ship, other locations became relatively easy to adapt. Thus, much of the following description will be with reference to installation and use of the system aboard a ship. Such description is by way of illustration and not by way of limitation.

Figure 2:
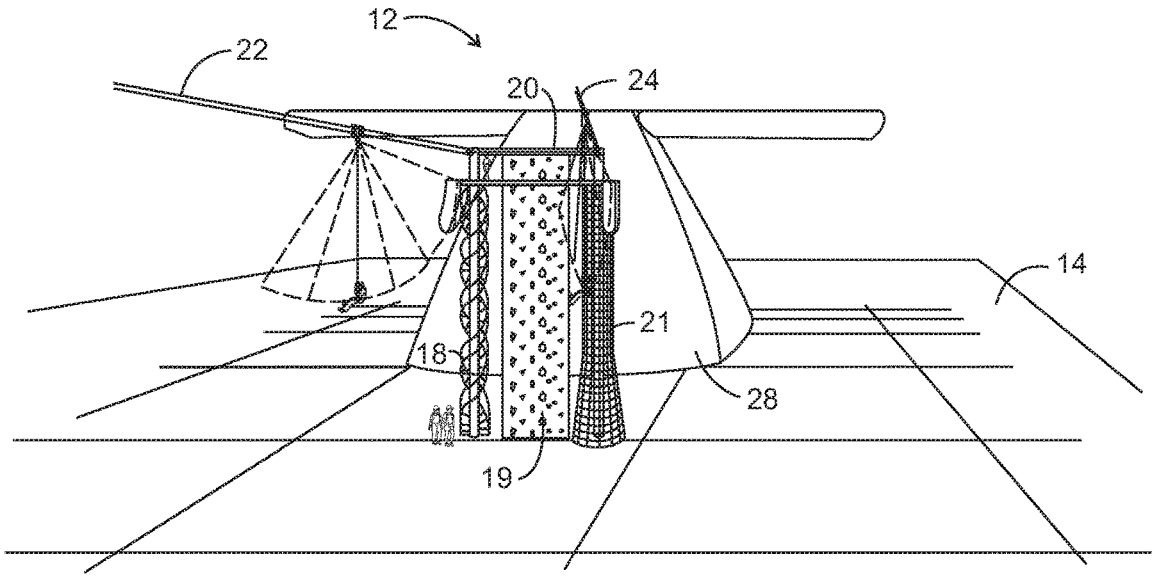
FIG. 2 is a forward view of the amusement ride of FIG. 1.
Figure 3:
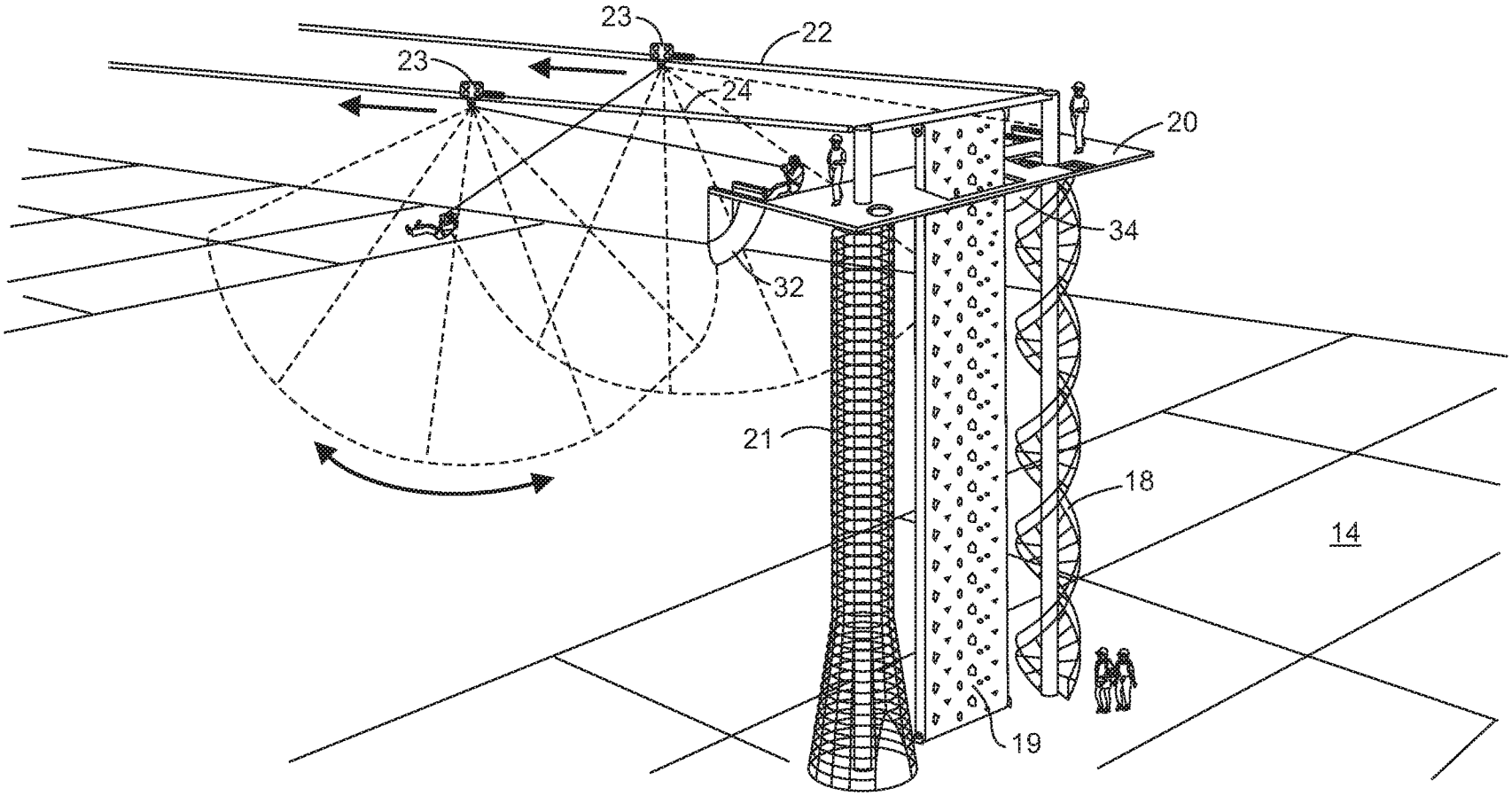
FIG. 3 is an isometric view of embodiment of the amusement ride of FIG. 1.

Referring additionally to FIGS. 2 and 3, it will be observed that ride 12 is positioned atop an upper deck, 14, at its start and ends atop another upper deck, 16 (see FIG. 1). The beginning and ending of ride 12 can be several hundred feet apart with the elevation of ride 12 being higher at the start than it is at the ending; thus, permitting gravity to provide the main mode of power to the traverse ride 12.

In this embodiment in the drawings, a pair of generally parallel lines permits two different riders to experience ride 12 at the same time. It will be appreciated that additional such lines could be established depending up space requirements.

The fixed base at the start could be a tree, tower, building, or virtually any structure that can support the rise. Virtually any height can be used by the disclosed amusement ride. Because of the small footprint of the ride, a cruise ship is an ideal location for the disclosed amusement rides. The height of the amusement ride can be static or dynamic.

The participant is outfitted in a harness and other required safety equipment, i.e., helmet, gloves, etc. The participant can access the ride using a spiral staircase, 18, up to a launch platform, 20, or alternatively a vertically oriented climbing wall (conveyor), 19, or net, 21, or combination. Staircase 18 can be a simple helix configuration or in a double helix configuration to increase the number of participants that can move up to the beginning of the amusement ride. Climbing wall 19 can be a continuous loop around rollers at the top and at the bottom and being connected to a power source so that it moves like a conveyor belt. In this fashion, the rider, if able, can climb the entire height of wall 19; or just a portion of the height with the wall then being activated to ferry the rider the rest of the way up to platform 20; or the entire height from deck 14 to deck 20 if the rider is unable to climb the wall, but wants the experience of going up a climbing wall. These various means of accessing platform 20 merely adds to the excitement of the amusement. Moreover, such continuously moving climbing wall is capable of rotating to different angles in order to stage an opportunity for a photograph or digital image or video to be taken of the person ascending the climbing wall. Such opportunities are created for all the various the modes of ascension, as part of the entertainment package disclosed herein.

Figure 11:
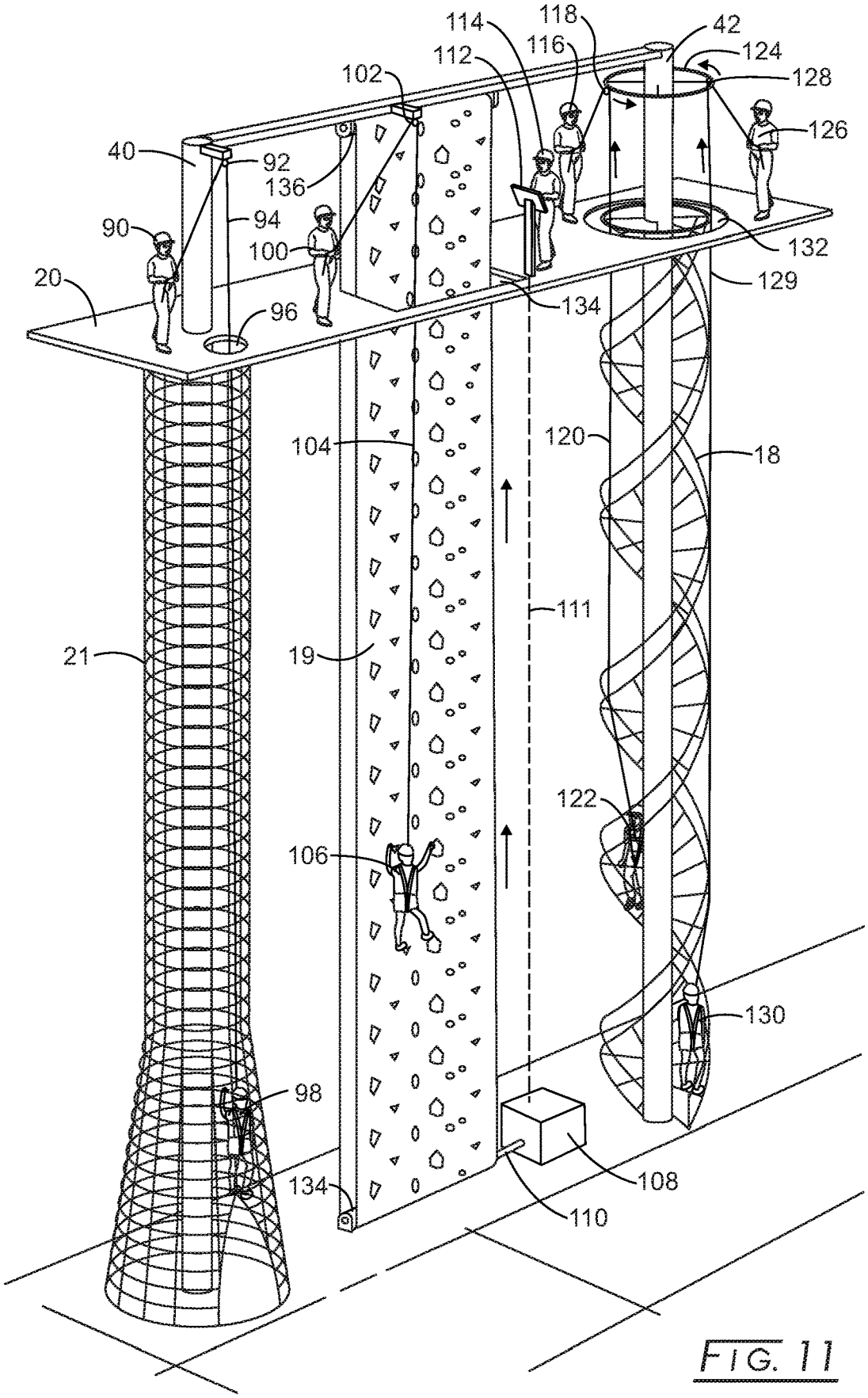
FIG. 11 is an enlarged isometric view of the different modes of ascension by which the participants can access the disclosed amusement rides.

More detail is provided in FIG. 11 for the different routes by which the participants can access the amusement rides. In particular, a participant, 98, ascending up net 21 is attached by a safety line, 94, through a belay, 92, or other one-way moving device, controlled by an operator, 90. An opening, 96, in platform 20 permits participant 98 to reach platform 20 and the amusement rides disclosed herein.

A participant, 106, climbing up moving climbing wall 19, is attached to a safety line, 104, through a belay, 102, to an operator, 100. A drive system, 108, rotates a shaft, 110, that powers a bottom roller, 134. At the top is an upper, non-powered roller, 136. A line, 111, connects drive system 108 to a controller, 112, being operated by another operator, 114. Should the participant not be able to fully ascent climbing wall 19 and emerge through an opening, 134, in platform 20, operator 114 can engage drive system 108 to cause climbing wall 19 to rotate and bring the participant up through an opening, 134, in platform 20 without the participant having to do anything but enjoy the ride up.

Two participants, 122 and 130, are ascending double helix spiral staircase 18 and are attached, respectively, to safety lines 120 and 129, through, respectively, belays 118 and 128, and, respectively, operators, 116 and 126. Belays 118 and 128 are affixed to a rotating ring, 124, that permit the safety lines to rotate to avoid tangling of the safety lines. In turn, operators 116 and 126 walk in a circular path as ring 124 rotates. The participants emerge through an opening, 132, in platform 20 to reach the platform and other amusement rides. The width of spiral staircase 18, single helix or double helix, determines the number of participants that can ascend together.

Dual lines, 22 and 24, upon which the participant rides, passes through a pulley, 26 (see FIGS. 4 and 5), for line 24 with a similar pulley not shown for line 22. Pulley 26 is affixed to a pole, 42 (see FIG. 6), at the beginning and to a pole, 30 (see FIG. 1 also), at the end of the ride. One or more operators are stationed on platform 20, as is necessary or desirable for safety. Chutes, 32 and 34, extend away from platform 20 and provide the entry for the participants to start the ride.

The participant is seated at the throat of the slide and prepares for launch. The participant wears a harness that is attached to a pulley, 23. The rider then scoots forward and down the chute and/or the operator gives the participant a slight push to start the slide down the chute. The slide radius is such that the tether becomes slightly slack as the participant proceeds down the slide. The participant then, reaching the end of the slide, continues in a forward motion caused by the arc of the slide creating a momentary free-fall. Then, as the participant reaches the extent of the length of the tether, which in most applications is a dynamic climbing rope used to absorb shock, the participant swings forward in the arc of the tether (see FIGS. 3 and 4).

Figure 4:
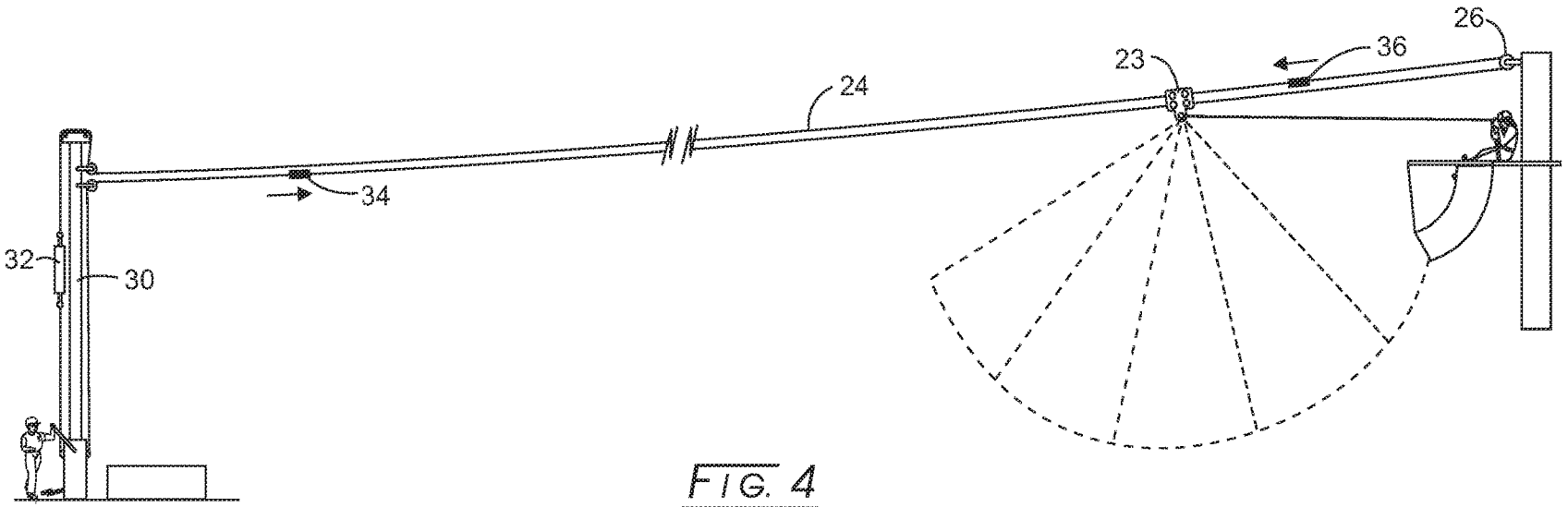
FIG. 4 is a side view showing how the rider is launched to experience the first amusement ride embodiment.
Figure 5:
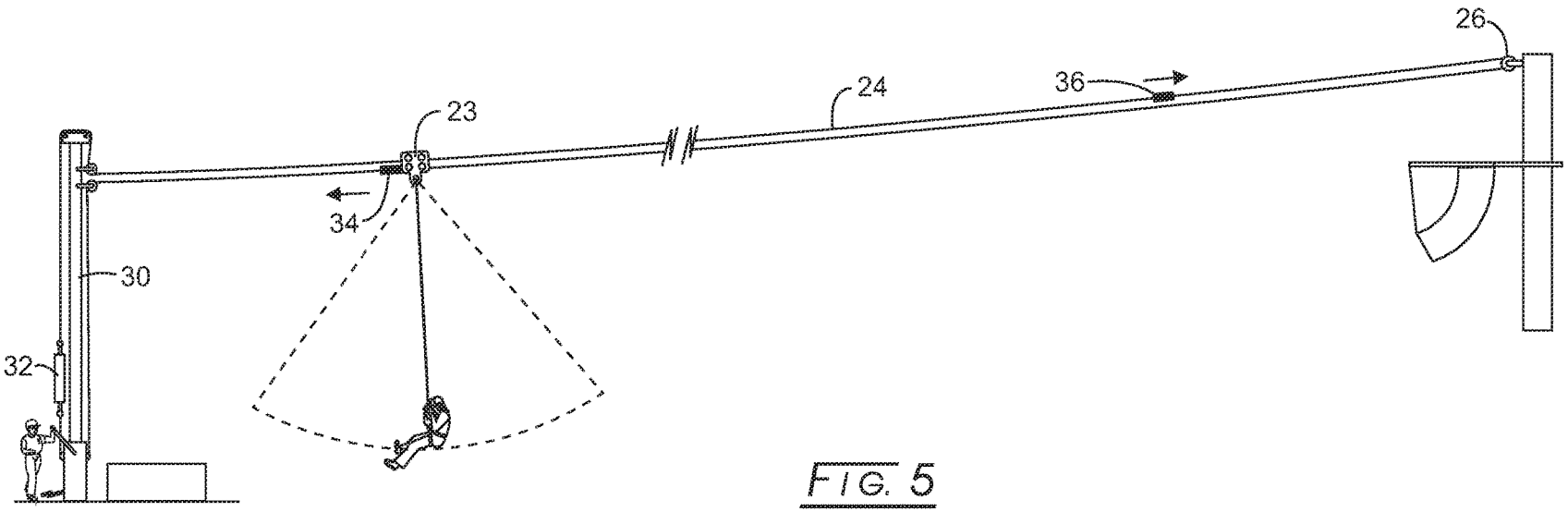
FIG. 5 is a side view showing the rider approaching the end of the first amusement ride embodiment.

FIGS. 4 and 5 illustrate the ride in greater detail. In particular, the operator at either the end of the ride, releases some slack in line 24, allowing a weight, 32, to pull a block or stop, 36, forward and, therefore, the rider into the slide (chute). Simultaneous with the forward action of upper block 36 pulling the rider into the chute, another block or stop, 34, at the lower end moves forward and up the traverse an equal distance to a secondary position and locks in place. The action of which will stop the rider a safe distance from the end allowing the rider to swing and dissipate forward momentum. Once the rider has dissipated enough momentum to be lowered safely, the operator releases the lock mechanism, which allows for the weight of the rider to reset the mechanism as the rider is lowered to the disembarkment point. At the same time a stop, 34, at the bottom of the ride is moved up the line to stop the rider allowing the rider to swing some more when contacting the stop. When the rider stops swinging the operator pulls on line 24 lowering the rider to the landing platform and at the same time the pulling stop, 36, at the top of the ride is moving back so the ride can reset for the next rider.

The counterweight system can be located at either the upper end or the lower end, and in some circumstances, at both ends. FIG. 4 illustrates the ride with the participant on the platform ready for launch. FIG. 5 illustrates the passenger at the terminus of the ride where pulley 23 hits stop 34, resulting in the participant swinging back and forth in an arcing motion.

Figure 6:
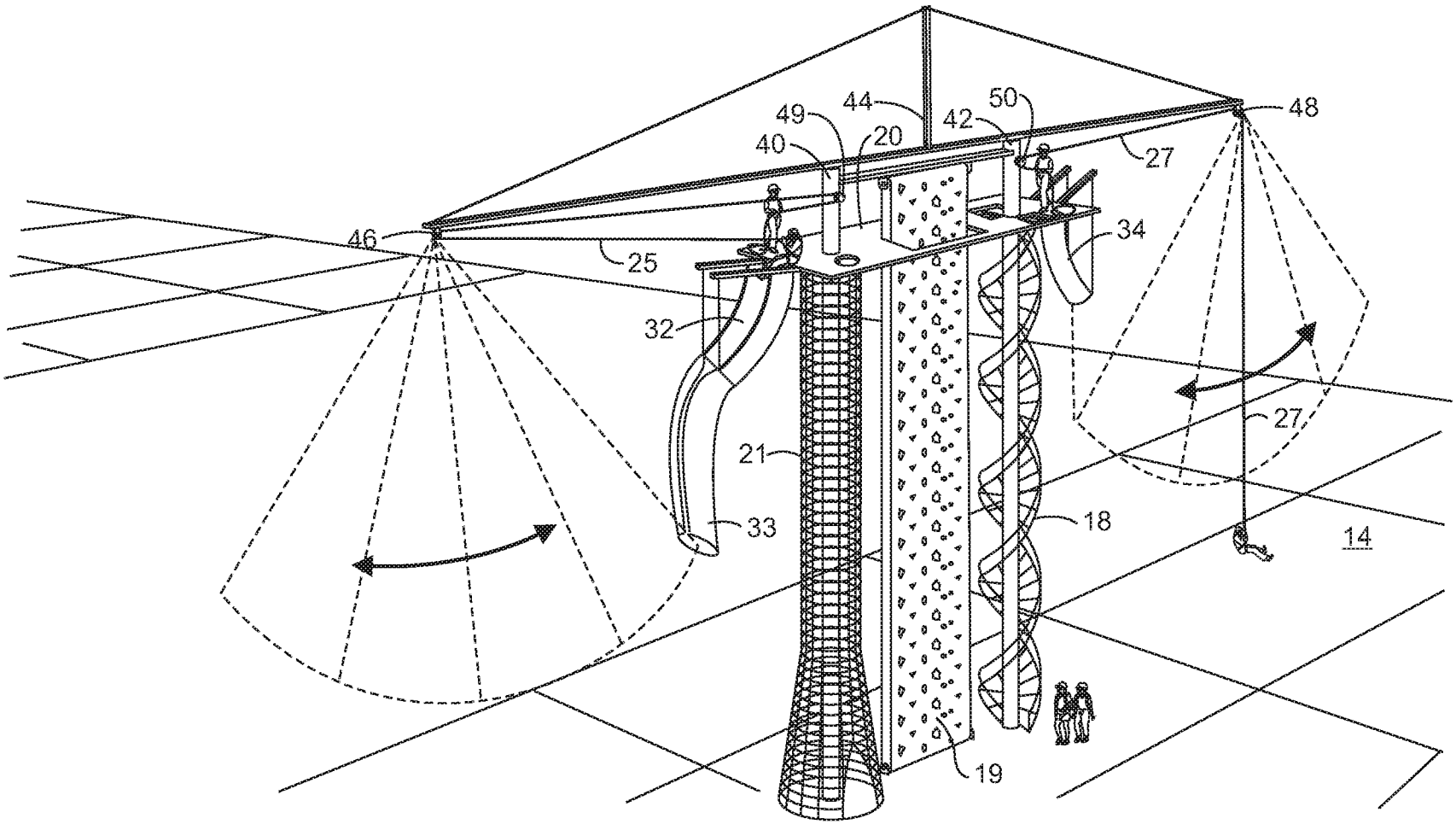
FIG. 6 is an isometric view of a second embodiment amusement ride that can be located aboard the same tower as shown for the previous embodiment.

The embodiment shown in FIG. 6 eliminates the dual cables of the first embodiment, but retains the remainder of the experience. That is, the participant can access platform 20 in the same manner described above using spiral staircase 18, moving climbing wall 19, or next 21. Once the participant is located on upper platform or deck 20, the participant puts on the same harness system and is hooked to a tether, 25, that runs through a pulley, 46, located at the end of an extend arm system, 44, located atop a pair of columns, 40 and 42, that each are supported by deck 20.

The participant is seated at the throat of slide 32 and prepares for launch. The operator pulls on tether 25 through a belay device, 49, which shortens the distance between the participant and fixed pulley 46. The radius of slide 32 is such that tether 25 becomes slightly slack as the participant proceeds down slide 32. The slide can be formed from polymeric material or fabric and suspended by flexible members, such as cable or fiberglass reinforced rods or other semi-rigid material. An optional shroud or baffle, 33, can be located at the lower end of slide 32. The participant is in darkness inside shroud 33 until emerging from the discharge end of shroud 33. Shroud 33 creates a tunnel-like effect, such that the participant has the sensation of falling in the dark. Shroud 33 also absorbs kinetic energy some of which is converted to sound energy by the rider sliding against the shroud material and some energy is absorbed by the supporting tether system. Such loss of energy puts the participant into a lower and more controllable arc and drop combination. Once the rider has dropped from the end of the slide/baffle and swung in an arc for a period of time, the operator can lower the rider onto a lower deck, crash mat, swimming pool, pit filled with balls or beans, air bag, or just about any safety amusement landing area. Without the shroud, the swing of the passenger may be uncontrollable and unsafe.

Referring now to FIGS. 7 and 8, a drop seat is illustrated for use with the first described embodiment; although, it can be used with both embodiments disclosed herein. In particular, the participant is hooked up to a harness system, gloves, etc., as described above. In this embodiment, however, the participant is seated in a drop chair assembly, 52, composed of a back, 54, fitted with a series of rollers, 56, and a seat, 58, also fitted with a series of rollers, 60. Drop chair assembly 52 is attached to a conveyor belt or similar mover, 62, that moves drop chair assembly 52 to move from an initial or home position where the rider first sits upon it to a launch position (shown in phantom in FIG. 8 with prime numbers for the corresponding parts described above). Upright back 54 of drop chair assembly 52 is pivotally connected to seat 58 of drop chair assembly 52. The operator can simply push drop chair assembly 52 to move it from the home position to the launch position shown in phantom. When the rider gets to the launch end, the chair suddenly tips forward by the weight of the rider sitting upon seat 58, permitting the rider to suddenly free-fall drop and the start swinging. The operator controls the ride from here as described above for the second embodiment.

An alternative launch design to that of slide 32 shown in FIG. 6, is launch tube assembly, 70, shown in FIGS. 9 and 10. In particular, the participant enters launch tube assembly 70 from platform 20 at a proximal opening of a launch tube, 72. The participant is in a reclined position and wears a harness tethered to pulley 23. An opening, 74, permits the operator to speak with the participant to determine that the participant is ready to be launched. An opening on the topside of tube 72 permits the tether to run between the harnessed participant and slide pulley 23. Tube 72 also has an opening at its distal end. A pivot, 76, attaches slide 72 to platform 20 via a clamp, 78. The harnessed participant scoots forward in tube 72 until the weight of the participant causes the distal end of tube 72 to rotate about pivot 76 to launch the participant, who immediate drops downwardly and then slidingly down line 24.

While the amusement ride has been described with reference to various embodiments, those skilled in the art will understand that various changes may be made and equivalents may be substituted for elements thereof without departing from the scope and essence of the disclosure. In addition, many modifications may be made to adapt a particular situation or material to the teachings of the disclosure without departing from the essential scope thereof. Therefore, it is intended that the disclosure not be limited to the particular embodiments disclosed, but that the disclosure will include all embodiments falling within the scope of the appended claims. In this application all units are in the metric system and all amounts and percentages are by weight, unless otherwise expressly indicated. Also, all citations referred herein are expressly incorporated herein by reference.

I claim:

1. An amusement ride wherein participants are required to ascend to a platform for a beginning of the amusement ride, the amusement ride comprises a double helix ladder for the participants to ascend to the platform; wherein the participants are tethered for safety, the tethers each running through a belay, and the belays being attached to a moving ring above the platform so that the tethers do not become tangled.

2. The amusement ride of claim 1, wherein operators secure the tethers to the moving ring after the belays.

* * * * *